United States Patent [19]

Profit

[11] Patent Number: 4,651,990

[45] Date of Patent: Mar. 24, 1987

[54] PROTECTIVE DEVICE FOR GOALTENDER HOCKEY STICK

[76] Inventor: Grant Profit, Box 1770, The Pas, Manitoba, Canada, R9A 1L1

[21] Appl. No.: 760,109

[22] Filed: Jul. 29, 1985

Related U.S. Application Data

[63] Continuation-in-part of Ser. No. 612,392, May 21, 1984, abandoned.

[51] Int. Cl.[4] ..... A63B 59/00; B65B 11/00

[52] U.S. Cl. ..... 273/67 A; 273/67 DB; 150/52 G

[58] Field of Search ..... 273/67 A, 67 DB, 67 DC, 273/162 R, 194 A; 150/52 G, 52 R; 30/151, 153, 155

[56] References Cited

U.S. PATENT DOCUMENTS

| | | | |
|---|---|---|---|
| 2,517,649 | 8/1950 | Frechtmann | 30/151 |
| 3,353,826 | 11/1967 | Traverse | 273/67 A |

FOREIGN PATENT DOCUMENTS

| | | | |
|---|---|---|---|
| 698375 | 11/1964 | Canada | 273/67 A |
| 867225 | 3/1971 | Canada | 150/52 G |
| 27842 | 12/1955 | Finland | 273/67 A |
| 108623 | 9/1943 | Sweden | 273/67 A |

*Primary Examiner*—Richard C. Pinkham
*Assistant Examiner*—Gary Jackson
*Attorney, Agent, or Firm*—Adrian D. Battison

[57] ABSTRACT

A detachable protective device for a goaltender hockey stick is formed as a channel with a base and upstanding front and rear panel for engaging the blade over the ice engaging portion and part way up the upstanding portion. A V-shaped slot at the heel enables the cover to be folded at the heel to wrap around the heel of the blade and to adjust for different lies of blade. The rear panel terminates at a lower upper edge so that tape wrapped around the cover and the stick can engage the stick at an exposed rear portion. Openings in the rear panel are provided to reduce the weight of material.

8 Claims, 4 Drawing Figures

15
162
123
124
13
163
131
16
132
20
12
164
161
111
11
4
18
121
10
19
191

PROTECTIVE DEVICE FOR GOALTENDER HOCKEY STICK

This application is a continuation in part of Application Ser. No. 612,392 filed May 21, 1984 now abandoned.

BACKGROUND OF THE INVENTION

The present invention relates to an improvement in protective devices for hockey sticks of a goaltender.

Goaltending hockey sticks are relatively expensive and while this may not be a factor in professional hockey, it constitutes a considerable expense for amateur and semi-professional hockey clubs.

Goaltending sticks are not used extensively during the game because only a relatively small number of shots are made on goal, but during practice, the sticks are in use all of the time and often become damaged, resulting in a requirement for many sticks during the hockey season.

Previous patents attempt to reinforce the stick by means of permanent attachments to the blade thereof and examples include U.S. Pat. No. 4,148,482 which teaches a textile tubing slipping over the blade after which resinous coat is applied over the tubing incorporating it permanently to the blade.

U.S. Pat. No. 4,172,594 shows a hockey stick blade which is reinforced with glass fiber and impregnated with a resin plastic, once again becoming a permanent part of the blade.

U.S. Pat. No. 3,353,826 discloses a reinforced hockey stick blade which is covered with a soft fiberglass yarn knitted with a very fine filament which is then covered with a layer of synthetic resin, once against becoming a permanent part of the stick.

U.S. Pat. No. 2,912,245 illustrates a hockey stick blade which is covered with a sleeve which is fabricated integrally with the blade.

All of these, while reinforcing the blade, form part of the actual manufacture of the stick and if they become damaged, they require complete replacement.

SUMMARY OF THE INVENTION

It is one object of the present invention, therefore, to provide an improved protective device for a goaltender hockey stick which can be applied and removed and which can be adjusted to accommodate different types of hockey sticks.

According to the invention, therefore, there is provided a protective device for a goaltender hockey stick of the type having a handle and a blade, the blade including a ice engaging portion and an upstanding portion connected to the handle and arranged at an angle to the ice engaging portion defining a heel therebetween, characterized in that the device comprises a channel member formed from a flexible sheet material defining a base, an upstanding front panel and an upstanding rear panel, said front panel being configured to substantially cover said ice engaging portion and part of said upstanding portion of said blade, said front and rear panels including slot means arranged to extend from a position adjacent said heel to an upper edge of the respective panel whereby said channel member can be slipped over said stick to a position in which said base is in engagement with an edge of the blade and said panels adjusted at said slot means to accommodate the angle between said ice engaging portion and said upstanding portion.

According to a preferred feature of the invention, the base tapers from the heel towards a toe end of the ice engaging portion so as to closely follow the ice engaging portion and ensure that the front panel lies flat against the ice engaging portion to avoid bubbles which can interfere with the reaction of the puck against the blade.

According to a further important aspect, the rear panel has an upper edge which is lower than the upper edge of the front panel so that when applied the upper edge of the front panel can closely follow the upper edge of the stick while the rear panel leaves a bare part of the rear surface of the blade. This enables the device to be attached to the blade simply by taping around the blade in the normal manner whereby the bare upper portion of the rear surface is engaged by the tape to hold the device in place.

According to a further important feature of the invention, the device is formed from a solid plastic material having a reaction relative to a puck substantially the same as that of wood so that when taped to the blade without bubbles the material of the device simulates that of wood so that bounces from the blade of the puck are substantially the same as if the device were removed.

According to a yet further important aspect of the invention, the slot means enabling the adjustment to accommodate different forms of stick is V-shaped so that the device normally lies flat with the base straight for simple packaging in an elongate package. When applied, however, the device can be folded at the slot means to take up the necessary position relative to the ice engaging portion and the upstanding portion of the blade.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which.

Figures 1, 2, 3:
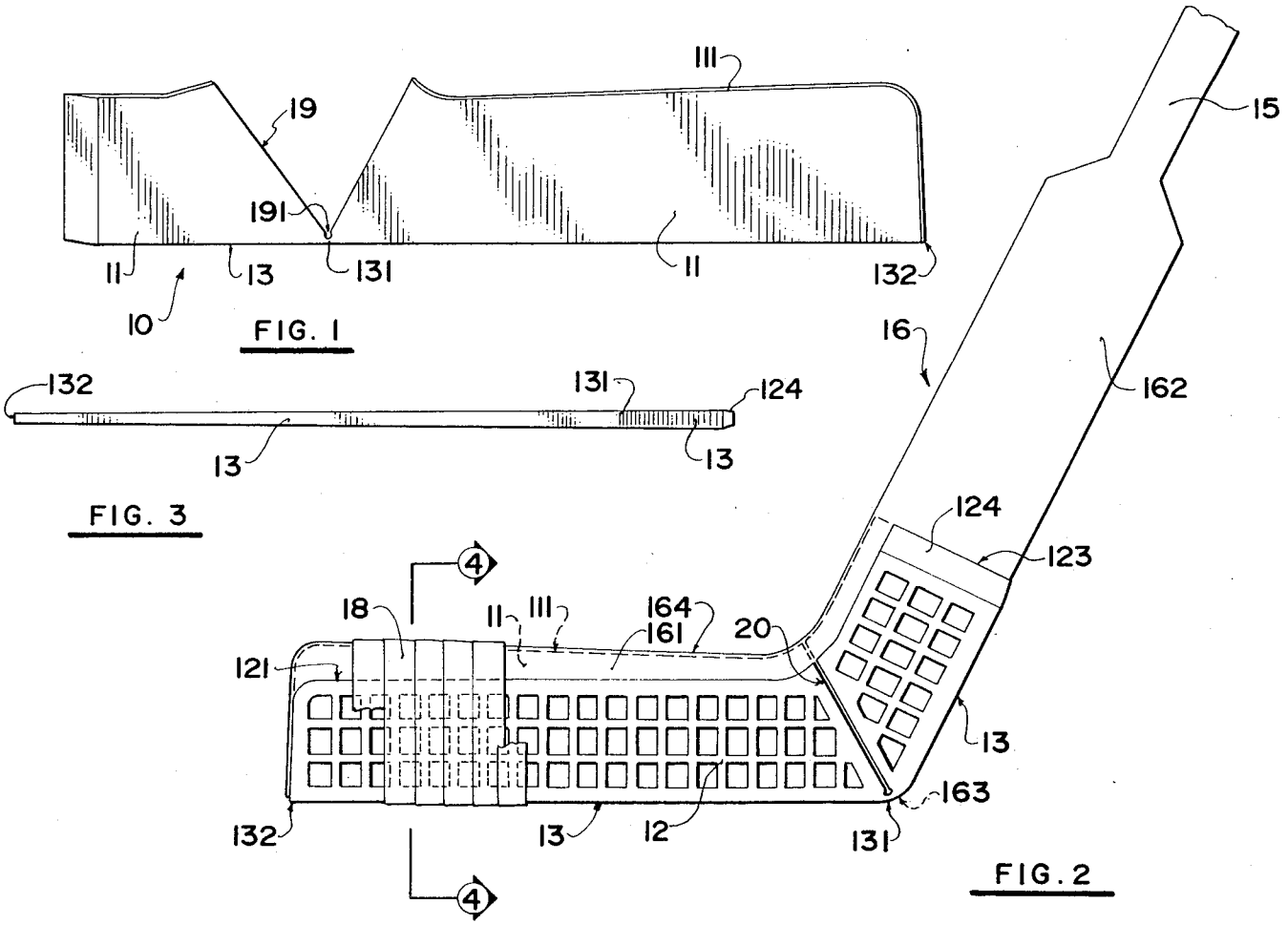
FIG. 1 is a front elevational view of a protective device according to the invention prior to application of a stick.
FIG. 2 is a rear elevational view of the device of FIG. 1 attached to a stick.
FIG. 3 is an underside view of the device of FIG. 1.

The protective device comprises a semi-rigid sleeve or channel member formed from a synthetic plastic material injection molded to the configuration as illustrated.

It is designed to be engaged over a goaltender hockey stick collectively designated 14 which includes handle portion 15, a blade portion 16 having an ice engaging blade portion 161 and an upstanding blade portion 162 inter-connected at the heel 163.

Figure 4:
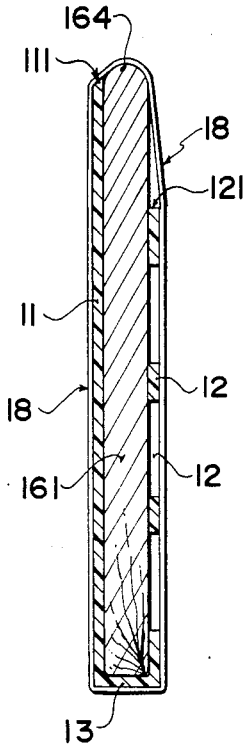
FIG. 4 is a cross sectional view along the lines 4—4 of FIG. 2.

The particular device is generally indicated at 10 and is designed to be a relatively close fit over the blade and heel terminating at a position part way up the upstanding portion 162 of the blade. The device comprises a channel member having a front panel 11 and a rear panel 12 inter-connected by a base 13. The front and rear panels 11 and 12 tend to converge slightly as shown in FIG. 4 from the base 13 towards an open end at an upper edge thereof. This enables the panels to grip a blade of the stick as indicated best in FIG. 4. In addition, the base 13 tapers from a position 131 which corresponds to the heel 163 towards a toe end indicated at 132 which is arranged to engage a toe end of the ice engaging portion 161 of the blade. The base 13 is substantially flat and inter-connected to the panels 11 and 12 at right angles thus confining the panels in semi-rigid state to the upstanding slightly inwardly tapering configuration shown in FIG. 4.

The front panel 11 has a top edge 111 which is arranged to follow as closely as possible the top edge of the blade indicated at 164. However, the rear panel 12 has an upper edge 121 which is lower than the front edge 111 and therefore terminates part way down a rear surface of the blade portion 161. This enables tape to be wrapped around the device with the front panel 11 laying flat against the front surface of the blade and the tape engaging the upper rear edge of the blade so as to hold the device in position on the blade. The tape is indicated at 18 in FIGS. 2 and 4.

The front and rear panels are divided into two sections by V-shaped slots 19, 20 which open onto the upper edge of the respective panel and terminate at an apex adjacent the heel portion 131. A circular opening 191 is arranged at the apex to allow the two portions of the panel to fold at the apex to take up the position shown in FIG. 2. The device is molded into a shape shown in FIG. 1 so it initially and normally takes up the orientation shown in FIG. 1 so that it can be packaged in a simple elongate package and then folded at the apex 191 into the position shown in FIG. 2 to accommodate the angle between the blade portions 161 and 162.

It will be appreciated that different manufacturer's sticks tend to have a slightly different angle between the portions 161 and 162, otherwise known as a "lie". The angle of the V-shaped slot 19 is chosen such that the edges of the slot are substantially touching when the device is deformed into the position shown in FIG. 2 to accommodate a blade having the shallowest angle between the blade portions 161 and 162. Thus when used with other types of blade which have a slightly greater angle, there is left a narrow gap as shown in FIG. 2 between the edges.

The preferred weight of the cover or protective device is arranged to be of the order of 150 grams in order to achieve this relatively low weight while providing a maximum thickness of the solid plastic material from which it is molded, the rear panel 12 has a plurality of openings formed therein either by cutting or by molding. While the openings are shown as squares, diamond shaped openings can be formed as these can provide the minimum amount of material while avoiding interfering with the rebound of the puck from the blade. Heavier covers can be used particularly for practice sessions in order to build up strength and to give a feeling of lightness of the stick when the heavier cover is removed.

The portion of the panels engaging the upstanding portion 162 are arranged to terminate at a convenient point part way up the portion 162. This point can of course vary depending upon design requirements but the majority of effectiveness of the cover is at the heel and and over the portion 161 since this is where damage most often occurs in view of the twisting forces involved. In order to avoid an outstanding edge on the portion 162 at the uppermost edge 123 of the panel 12, a feathered portion 124 is provided in which the thickness of the material tapers down towards the edge 123. In this way when tape is wrapped around the device completely covering the device the tape can pass over the edge 123 without forming a substantial outstanding step which could interfere with the proper rebound of the puck if it engages the step.

The device is molded from a solid plastic material as a single layer with the material chosen to have resilience or rebound characteristics the same as that of wood so that when properly attached to the blade without bubbles or air pockets between the cover and the blade, the rebound characteristics of the puck on the blade are the same as if the cover were removed.

I claim:

1. A combination of a goaltender hockey stick of the type having a handle and a blade, the blade including an ice engaging portion and an upstanding portion connected to the handle and arranged as an angle to the ice engaging portion defining a heel therebetween and a protective device therefor, said device comprising an integral molded channel member formed from a flexible sheet material defining a base, an upstanding front panel and an upstanding rear panel, said front and rear panels being unconnected to each other at upper edges thereof, said front panel being configured to substantially cover said ice engaging portion and part of said upstanding portion of said blade, said front and rear panels including slot means arranged to extend from a position adjacent said heel to break out of said upper edge of the respective panel, said channel member being slipped over said stick to a position in which said base is in engagement with an edge of the blade and said panels adjusted at said slot means to accommodate the angle between said ice engaging portion and said upstanding portion the upper edge of rear panel the being lower than that of the front panel so that the upper edge of the front panel lies substantially co-incident with the upper edge of the ice engaging portion of the blade and the upper edge of the rear panel lies across a rear surface of the ice engaging portion downwardly from the upper edge thereof and a tape wrapped around said stick and said device such that said tape engages said rear surface of said ice engaging portion above said rear edge of said upper panel.

2. A device according to claim 1 wherein the base tapers in transverse width from said heel toward a toe end of said ice engaging portion.

3. A device according to claim 1 wherein the front panel has an upper edge, the height of which from the base increases toward a toe end of said ice engaging portion from said heel.

4. A device according to claim 1 wherein the front panel provides a smooth flat surface for laying flat against a front surface of the ice engaging portion of the blade.

5. A device according to claim 1 formed from a solid plastics material arranged to have a reaction relative to a puck substantially the same as that of wood.

6. A device according to claim 1 wherein the front and rear panels and base of said channel member taper in thickness at an end thereof engaging the upstanding portion of the blade whereby to avoid a sharp edge thereof outstanding from said upstanding portion.

7. A device according to claim 1 including openings formed in said rear panel so as to reduce the material thereof whereby to reduce the weight of said device.

8. A protective device for a goaltender hockey stick of the type having a handle and a blade, the blade including an ice engaging portion and an upstanding portion connected to the handle and arranged at an angle to the ice engaging portion defining a heel therebetween, characterized in that the device comprises a channel member formed from a flexible sheet material defining a base, an upstanding front panel and an upstanding rear panel, said front panel being configured to substantially cover said ice engaging portion and part of said upstanding portion of said blade, said front and rear panels including slot means arranged to extend from a position adjacent said heel to an upper edge of the respective panel whereby said channel member can be slipped over said stick to a position in which said base is in engagement with an edge of the blade and said panels adjusted at said slot means to accommodate the angle between said ice engaging portion and said upstanding portion, wherein said slot means is substantially V-shaped defining edges thereof whereby when separated from said stick the base of the channel member is substantially straight and when attached to said stick said edges of said V-shaped slot are substantially touching when used with a stick having the smallest angle between the upstanding portion and the ice engaging portion and wherein the slot means has a circular opening at the apex of the V-shape.

* * * * *